US006109972A

United States Patent [19]

Leinonen et al.

[11] Patent Number: 6,109,972

[45] **Date of Patent: *Aug. 29, 2000**

[54] PLUG

[75] Inventors: Ismo Leinonen; Olli Eloranta, both of Espoo, Finland

[73] Assignee: Nokia Telecommunications Oy, Espoo, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 09/029,758

[22] PCT Filed: Aug. 28, 1996

[86] PCT No.: PCT/FI96/00460

§ 371 Date: Mar. 2, 1998

§ 102(e) Date: Mar. 2, 1998

[87] PCT Pub. No.: WO97/08784

PCT Pub. Date: Mar. 6, 1997

[30] Foreign Application Priority Data

Aug. 28, 1995 [FI] Finland ..... 954036

[51] Int. Cl.[7] ..... H01R 13/66

[52] U.S. Cl. ..... 439/620

[58] Field of Search ..... 439/620, 608

[56] References Cited

U.S. PATENT DOCUMENTS

| | | | |
|---|---|---|---|
| 4,440,463 | 4/1984 | Gliha, Jr. et al. | 439/620 |
| 5,257,949 | 11/1993 | Paulus | 439/620 |

FOREIGN PATENT DOCUMENTS

| | | |
|---|---|---|
| 339802 | 11/1989 | European Pat. Off. . |
| 3808330 | 9/1989 | Germany . |
| 3624571 | 8/1992 | Germany . |
| 4219806 | 12/1993 | Germany . |

*Primary Examiner*—Gary F. Paumen
*Attorney, Agent, or Firm*—Pillsbury Madison & Sutro LLP

[57] ABSTRACT

The invention relates to a plug comprising: a body portion, an elongated conductive connector projecting from the body portion for receiving one or more conductors, at one end of which connector are arranged means for bringing said conductor into contact with a connector in a plug counterpart; a tubular capacitor threaded around the connector so as to couple an inner surface forming a first pole of the tubular capacitor to the connector; and grounding means coupled to an outer surface forming a second pole of the tubular capacitor, the grounding means being arranged to ground said second pole of the tubular capacitor. To facilitate the assembly of the plug, the grounding means comprise a flexible conductive element which is arranged to press like a spring against the outer surface of the tubular capacitor to ground said second pole of the capacitor.

6 Claims, 2 Drawing Sheets

PLUG

This application is the national phase of international application PCT/FI96/00460 filed Aug. 28, 1996 which designated in the U.S.

BACKGROUND OF THE INVENTION

1. Field of the Invention

The invention relates to a plug comprising: a body portion, an elongated conductive connector projecting from the body portion for receiving one or more conductors, at one end of which connector are arranged means for bringing said conductor into contact with a connector in a plug counterpart, a tubular capacitor threaded around the connector so as to couple an inner surface forming a first pole of the tubular capacitor to the connector, and grounding means coupled to an outer surface forming a second pole of the tubular capacitor, the grounding means being arranged to ground said second pole of the tubular capacitor.

2. Description of the Related Art

The term "elongated connector" as used herein refers to e.g. a needle-shaped fairly long connector whose length is sufficient for a tubular capacitor to be threaded thereon.

This invention relates to a disturbance shielded plug adapted for use in environments with a relatively strong interfering electromagnetic field. The plug according to the invention is adapted for use with e.g. telecommunications equipment, radio transmitters and the like. If a conventional non-shielded plug, to which e.g. a conventional multipolar cable is connected, were used in the strong RF field surrounding radio transmitters, the field surrounding the plug and the cable would cause such strong interference that hardly any useful signal could be transmitted via the cable and the plug.

It is known to utilize a conventional non-shielded plug with a shielded cable in places with a strong interfering electromagnetic field. In this case a multipolar cable is commonly used, with e.g. an aluminium foil layer arranged under an insulating material layer forming the external armature of the cable. For practical reasons a shielded cable cannot, however, be used in all places, and its cost is also relatively high compared with conventional cables.

Additionally, it is known to utilize a shielded so-called D-plug with a conventional non-shielded cable in places with a strong interfering electromagnetic field. In this case tubular capacitors are arranged around the elongated connectors in the plug. In this solution a first pole of the tubular capacitors, formed by their inner surfaces, is soldered to the connector around which that particular tubular capacitor is arranged. Furthermore, the outer surface forming a second pole of the tubular capacitors is soldered to a grounding plate in the plug. When the tubular capacitors are correctly designed, they can be used to filter e.g. interference caused by an external RF field, thus allowing the utilization of a non-shielded cable with said plug.

The most significant disadvantage of the above known shielded plug is that it is complicated to assemble. This is because each tubular capacitor must be separately soldered both to that particular connector around which it is arranged and to the grounding plate in the plug. As a plug may comprise several connectors, e.g. 64, this would result in the number of necessary solders being 128. Owing to the small size of the tubular capacitors (diameter e.g. approx. 1 to 2 mm, and height e.g. approx. 2 mm) and the lack of space in the plug, providing soldering to the right places requires extreme accuracy. Thus, the assembly of the plug is slow and expensive.

SUMMARY OF THE INVENTION

The object of this invention is to solve the above problem and to provide a shielded plug that is significantly simpler to assemble than known solutions. This goal is achieved with the plug according the invention, which is characterized in that the grounding means comprise a flexible conductive element which is arranged to press like a spring against the outer surface of the tubular capacitor to ground said second pole of the capacitor.

The invention is based on the idea that once the grounding means of a plug are provided with a springlike portion which presses against the outer surface forming a second pole of the tubular capacitor, the outer surface of the tubular capacitor can be grounded without soldering. If the springlike portion is also designed so that the force it directs to the tubular capacitor is such that the tubular capacitor presses with considerable force towards a connector penetrating through it, so that the inner surface forming a first pole of the tubular capacitor is brought into contact with the outer surface of the connector, there is no need to solder the inner surface of the tubular capacitor to the connector. The most significant advantage of the plug according the invention is thus that it is significantly simpler, faster and less expensive to assemble than known plugs, as the number of necessary solderings is significantly lower than in known solutions. Advantageously, the tubular capacitors can be installed into the plug without any soldering.

In a preferred embodiment of the plug according to the invention, the plug comprises a cover portion, separate from the body portion and provided with apertures through which the ends of the connectors can penetrate. The cover portion is connected to the body portion so that the cover portion and the body portion are pressed against the end surfaces of the tubular capacitors, whereby the tubular capacitors can be locked in place. This prevents the tubular capacitors from moving under the influence of e.g. vibration, which would impair the contact between them and the connectors.

In another preferred embodiment of the plug according to the invention, the above flexible element is arranged so that placing the cover portion in place causes the flexible element to press against the tubular capacitor. Thus the flexible element can be formed such that it does not direct any notable force against the tubular capacitor until the cover portion is in place. This simplifies further the assembly of the plug as placing a small tubular capacitor in place may be difficult if a springlike portion is pressed against it during assembly.

The preferred embodiments of the plug according to the invention are disclosed in the attached dependent claims 2 through 6.

The invention is described further hereinafter, by way of a few preferred embodiments of the plug according to the invention with reference to the accompanying drawings, in which:

DESCRIPTION OF THE PREFERRED EMBODIMENTS

Figure 1:
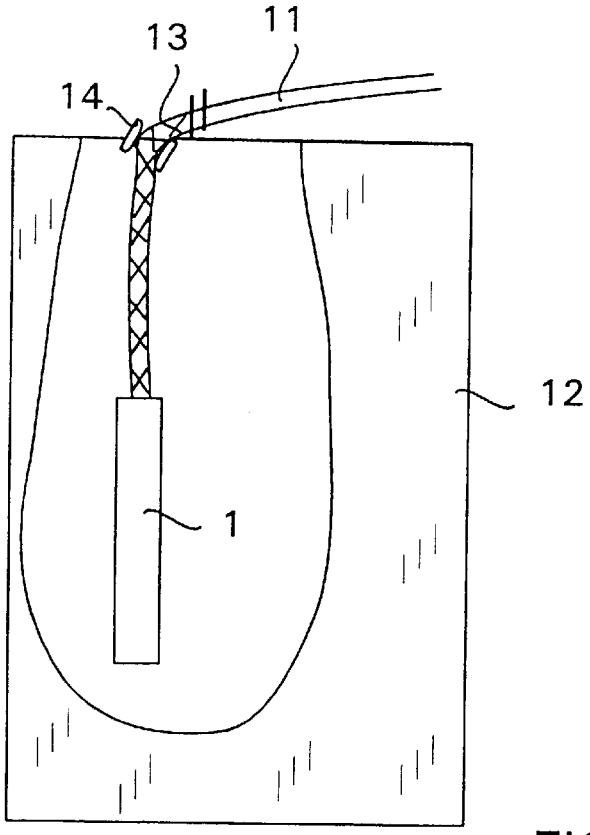
FIG. 1 illustrates the use of a plug according to the invention.

FIG. 1 illustrates the use of a plug according to the invention. The plug 1 in FIG. 1 is connected to e.g. a base station in a cellular radio system. Thus there is a strong RF-field in a casing 12 inside which the plug 1 is arranged. The RF-field would cause interference for a non-shielded plug and cable. The plug 1 is, however, shielded, and a conventional non-shielded multipolar cable 11 can be used in connection thereto. A metal texture net 13 is arranged on the outer surface of the cable 11 inside the casing 12, the net being grounded to the casing 12 by means of connectors 14, and also coupled to the metal casing of the plug 1. The plug 1 is preferably encased in a metal casing.

Figure 2:
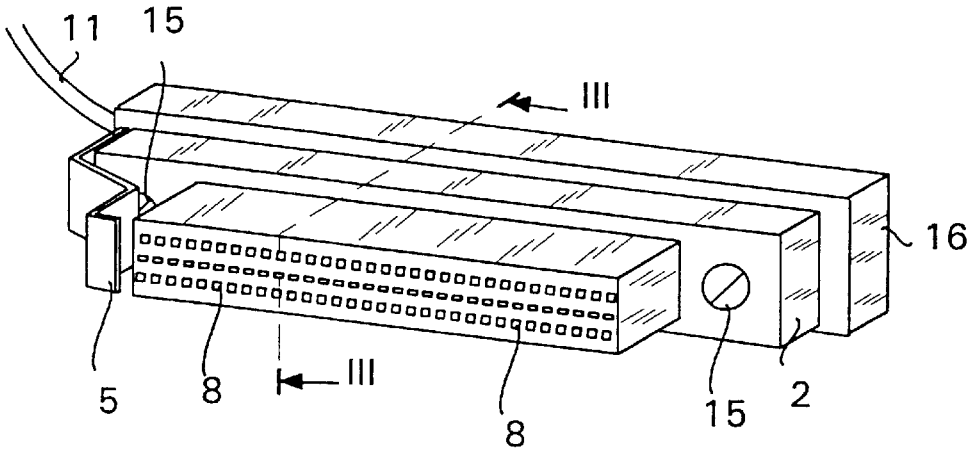
FIG. 2 illustrates a first preferred embodiment of the plug according to the invention.

FIG. 2 illustrates a first preferred embodiment of the plug according to the invention. The plug 1 presented in FIG. 2 may be e.g. a 64-pole Euro connector.

A body portion 2 of the plug 1 is attached by means of screws 15 to a metal casing 16. The metal casing comprises an aperture through which the cable 11 is led to the plug. The cable 11 consists of a plurality of separate conductors each of which is connected by means of the connectors of the plug (cf. FIG. 3) to a contact 8. Thus the contacts 8 connect the conductors to the contacts in a counterpart (not shown) of the plug.

The left edge of the plug comprises a metal grounding contact 5 designed so that it is grounded when the plug 1 is connected to its counterpart. The concept "grounded when the plug is connected to its counterpart" as used herein suggests that when the plug is inserted in a counterpart of a plug in an electric appliance, the grounding contact is grounded either once it comes into contact with a grounding contact in the counterpart or alternatively once it comes directly into contact with the body of the electric appliance.

Figure 3:
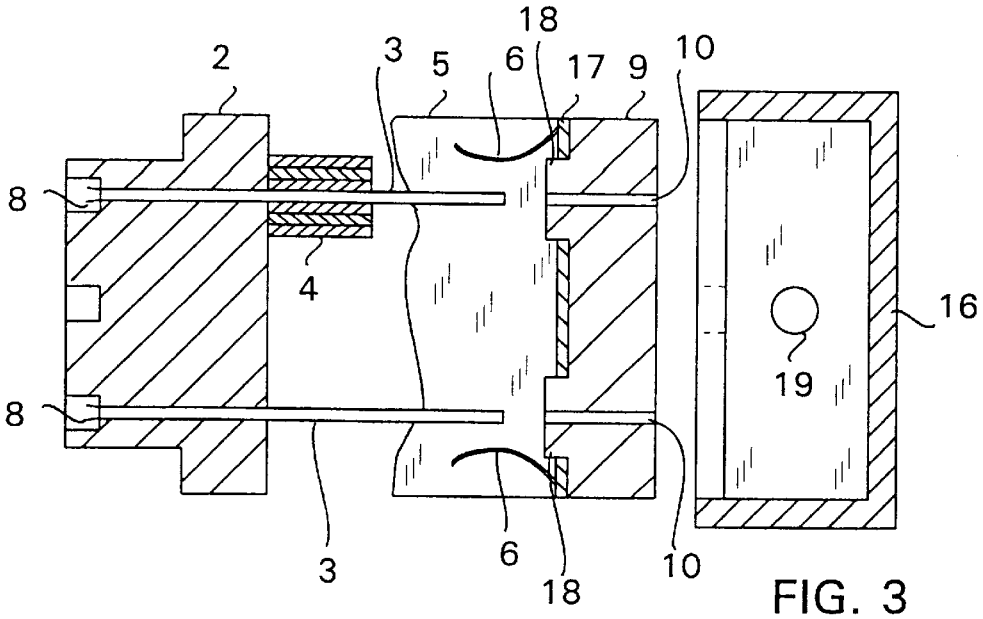
FIG. 3 is a partial section of the plug of FIG. 2.

FIG. 3 shows the plug of FIG. 2 in partial section taken on the line III—III. In FIG. 3 the parts of the plug 1 are, however, shown apart to simplify the distinction of one from the other. FIG. 3 thus illustrates also the assembly of the plug 1.

The body portion 2 of the plug 1 can be e.g. of plastic. The body portion comprises elongated metal connectors 3 to the right end (in FIG. 3) to which one or more cable 11 conductors are connected. Metal contacts 8 are arranged at the left ends of the connectors, by means of which the cable 11 conductors are brought into contact with a plug 1 counterpart.

In FIG. 3, a sleeve-like tubular capacitor 4 is threaded on the upper connector 3. Such a tubular capacitor is preferably threaded on each connector, i.e. even on the lower connector 3 shown in FIG. 3.

The tubular capacitor 4 is formed of a tubular capacitor known per se and the inner surface forming its first pole can be e.g. of a mixture of lead and tin. Correspondingly, the outer surface forming the second pole of the capacitor can be e.g. of a mixture of lead and tin. Between the inner and outer surfaces formed of the mixture of lead and tin is arranged a third layer of e.g. some ceramic material. If the plug of FIG. 3 is used e.g. in such circumstances in which the frequency of the interfering field surrounding it is 0 to 2 MHz, and the frequency of the signal transmitted through the connector 3 is approx. 2 MHz, 120 pF tubular capacitors can be chosen for the plug 1, whereby the form of the pulses transmitted through the plug does not change significantly.

The plug of FIG. 3 comprises additionally a lid portion 9 made of plastic, with apertures 10 through which the connectors 3 penetrate when the lid portion 9 is being connected to the body portion 2. This is when the tubular capacitors 4 are locked in place between the lid portion and the body portion. The whole lid portion 9 fits into the metal casing 16 of the plug 1 once the plug is assembled. Hence the lid portion is not shown in FIG. 2.

The lid portion 9 is provided with a metal grounding plate 17 parallel to its surface, the plate covering essentially the whole surface facing its body portion. However, a plastic projection 18 projecting from the plate 17 so that there is no contact between the end surfaces of the tubular capacitors 4 and the plate 17, is arranged in connection with each aperture 10.

At each aperture 10 a flexible metal projection 6 projects from the grounding plate 17, the projection being arranged to press against the outer surface of its respective tubular capacitor 4 when the lid 9 and the body portion 2 are connected. In addition, the grounding contact 5 shown in the background of FIG. 3 (in partial section) projects from the grounding plate 17. The operation of this contact is described in connection with FIG. 2.

In an assembled plug the flexible metal projections 6 press in a spring-like manner towards the outer surfaces of the tubular capacitors 4, the outer surfaces being thus grounded through the grounding plate 17 and the grounding connector 5. In addition, the radial force directed to the tubular capacitors 4 brings the inner surfaces of the tubular capacitors 4 into contact with the connector 3. Most advantageously, the tubular capacitors need not be soldered at all.

FIG. 3 further shows the metal casing 16 of the plug 1 with an aperture 19 for receiving the cable 11. When the plug is being assembled, the body portion 2 and the lid portion 9 are pressed together once the tubular capacitors 4 have been mounted and thereafter the body portion 2 is fastened by means of e.g. screws 15 to the casing 16.

Figure 4:
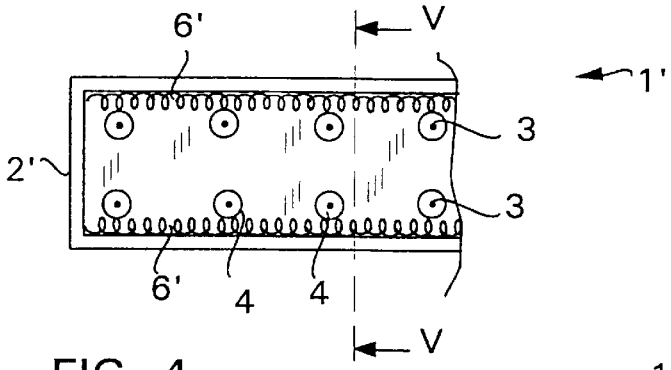
FIG. 4 illustrates a second preferred embodiment of the plug according to the invention.

FIG. 4 illustrates a second preferred embodiment of the plug according to the invention. FIG. 4 shows a body portion 2' of a plug 1' in partial section. In FIG. 4 the ends of connectors 3, to which the conductors are supposed to be connected, project towards the reader.

As may been seen from FIG. 4, a tubular capacitor 4 is threaded around each connector 3. The embodiment of FIG. 4 differs from that of FIGS. 2 and 3 in that in FIG. 4 the plug 1' comprises only two flexible elements 6' through which all tubular capacitors 4 of the plug 1' are grounded. The flexible elements 6' can be formed of e.g. spiral springs arranged to contact the outer surfaces of the tubular capacitors 4.

Figure 5:
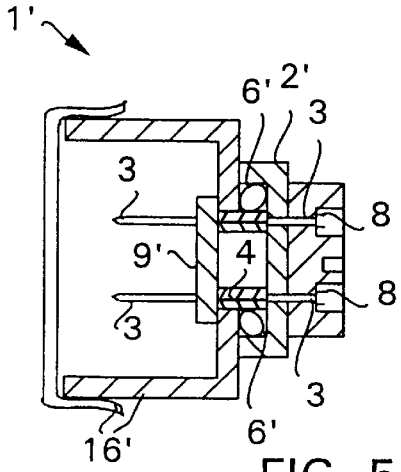
FIG. 5 is a partial section of the plug of FIG. 4.

FIG. 5 is a partial section of the plug of FIG. 4 taken on the line V—V. However, a lid 9' and a metal casing 16', not shown in FIG. 4, have been added to FIG. 5.

Even in the embodiment of FIG. 5 the connectors 3 are connected to contacts 8 which thus connect the conductors to be connected to the left ends of the connectors to contacts in a counterpart (not shown) of the plug 1'.

As is evident from FIG. 5, the spiral springs 6' have been compressed when the lid portion 9' has been put in place. The lid portion 9' remains in place owing to friction between itself and the connectors 3. The spiral springs 6' are shown as ellipses in contact with the tubular capacitors 4.

FIG. 5 further shows that the plug 1' does not comprise a separate grounding plate; instead the two-piece metal casing 16' of the plug 1' functions as a grounding element against which the spiral springs press when the lid portion 9' is in place. Thus the metal casing 16' comprises a grounding contact (not shown) through which it is grounded to a grounding contact in the counterpart of the plug 1' or alternatively directly to the body of an electric appliance.

It will be understood that the purpose of the above description and the accompanying drawings is only to illustrate the present invention. It will be obvious for those skilled in the art that various variations and modifications of the invention are possible without departing from the scope and spirit of the invention disclosed in the attached claims.

What is claimed:

1. A plug comprising:

a body portion having at least one end;

an elongated conductive connector projecting from the body portion for receiving at least one conductor;

contacting means arranged in the vicinity of the at least one end for bringing said conductor into contact with another connector in a plug counterpart;

a tubular capacitor threaded around the conductive connector, said tubular capacitor comprising a first pole having an inner surface and a second pole having an outer surface;

grounding means coupled to said outer surface forming the second pole of the tubular capacitor;

wherein said grounding means includes a flexible conductive element arranged to resiliently contact the outer surface of the tubular capacitor, to press said first pole of the tubular capicitor against said conductive connector for coupling said first pole to said connector, and to ground said second pole of the capacitor; and a lid portion, the lid portion (i) being separate from the body portion, (ii) provided with a number of apertures, and (iii) connected to the body portion so that the connector projects through one of the number of apertures;

wherein the body portion and the lid portion, when connected to each other (i) press against end surfaces of the tubular capacitor and (ii) fasten the tubular capacitor in place.

2. A plug as claimed in claim 1, wherein the plug comprises a plurality of connectors and a plurality of tubular capacitors, wherein each tubular capacitor is threaded around one connector, the first pole of the capacitor being connected to one of the plurality of connectors, and the second pole being grounded by said grounding means when the plug is connected to the plug counterpart.

3. A Plug as claimed in claim 2, wherein the grounding means comprises a separate conductive flexible element for each of the plurality of tubular capacitors, the flexible element pressing against the second pole of its respective tubular capacitor and for grounding the pole.

4. A plug as claimed in claim 2, wherein the grounding means comprises a conductive flexible element arranged to press against the outer surface of each of the plurality of tubular capacitors, said flexible element grounding the second poles of said plurality of capacitors.

5. A plug as claimed in claim 1, wherein the flexible element is arranged to be in connection with the lid portion.

6. A plug as claimed in claim 1, wherein the flexible elements are biased against the tubular capacitor when the lid portion is fastened in place, the conductive elements yielding elastically thereby so that internal tension is formed, the internal tension biasing the elements against the tubular capacitor.

* * * * *